US005880694A

United States Patent [19]

Wang et al.

[11] Patent Number: 5,880,694

[45] Date of Patent: Mar. 9, 1999

[54] PLANAR LOW PROFILE, WIDEBAND, WIDE-SCAN PHASED ARRAY ANTENNA USING A STACKED-DISC RADIATOR

[75] Inventors: Allen T. S. Wang, Buena Park; Kuan Min Lee, Brea; Ruey Shi Chu, Cerritos, all of Calif.

[73] Assignee: Hughes Electronics Corporation, El Segundo, Calif.

[21] Appl. No.: 878,171

[22] Filed: Jun. 18, 1997

[51] Int. Cl.[6] ..... H01Q 1/38

[52] U.S. Cl. ..... 343/700 MS; 343/757; 343/763; 343/713; 343/846; 343/829; 343/848; 343/830

[58] Field of Search ..... 343/700 MS, 757, 343/763, 713, 846, 829, 848, 830; H01Q 1/38

[56] References Cited

U.S. PATENT DOCUMENTS

| | | | |
|---|---|---|---|
| 5,006,859 | 4/1991 | Wong et al. | 343/700 MS |
| 5,210,542 | 5/1993 | Pett et al. | 343/700 MS |
| 5,497,164 | 3/1996 | Croq | 343/700 MS |
| 5,777,581 | 7/1998 | Lilly et al. | 343/700 MS |
| 5,785,793 | 7/1998 | Maeda et al. | 343/700 MS |

*Primary Examiner*—Frank G. Font
*Assistant Examiner*—Layla G. Lauchman
*Attorney, Agent, or Firm*—Michael W. Sales

[57] ABSTRACT

A phased array antenna having stacked-disc radiators embedded in dielectric media. The phased array antenna has a rectangular arrangement of unit cells that are disposed on a ground plane. A lower dielectric puck with a high dielectric constant is disposed on the ground plane. An excitable disc is disposed within the perimeter of and on top of the lower dielectric puck. An upper low dielectric constant dielectric puck that has a dielectric constant lower than that of the lower dielectric puck is disposed on the excitable disc. A parasitic disc is disposed within the perimeter of and on top of the upper dielectric puck. Dielectric filler material having a dielectric constant that is lower than that of the lower dielectric puck surrounds the dielectric pucks. A radome 18 is disposed on top of the parasitic disc and the unit cell. Two orthogonal pairs of excitation probes are coupled to the lower excitable disc. The polarization of the phased array antenna may be single linear polarization, dual linear polarization, or circular polarization depending on whether a single pair or two pairs of excitation probes are excited

8 Claims, 6 Drawing Sheets

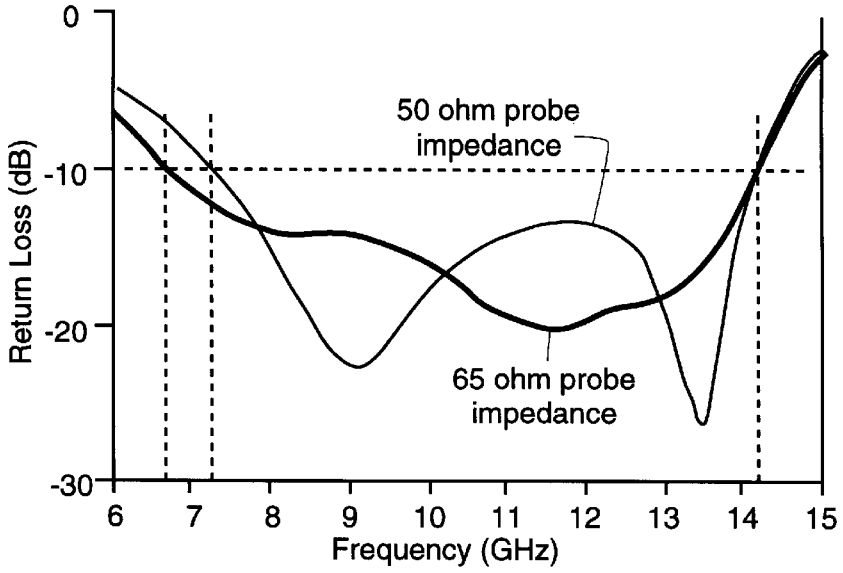
Fig. 5
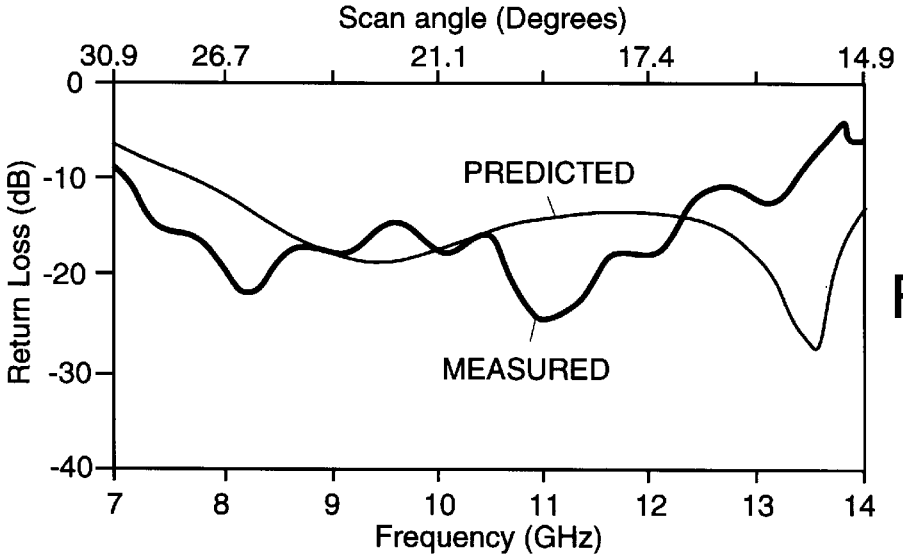
Fig. 6
Fig. 7
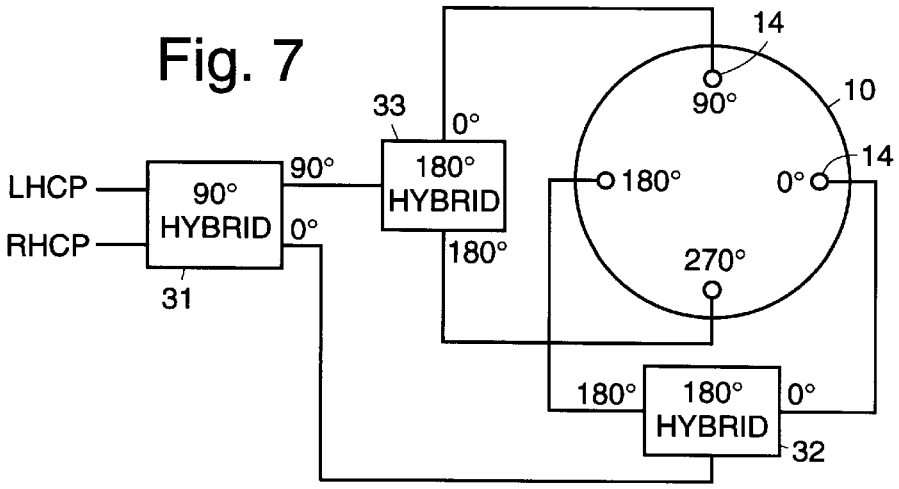

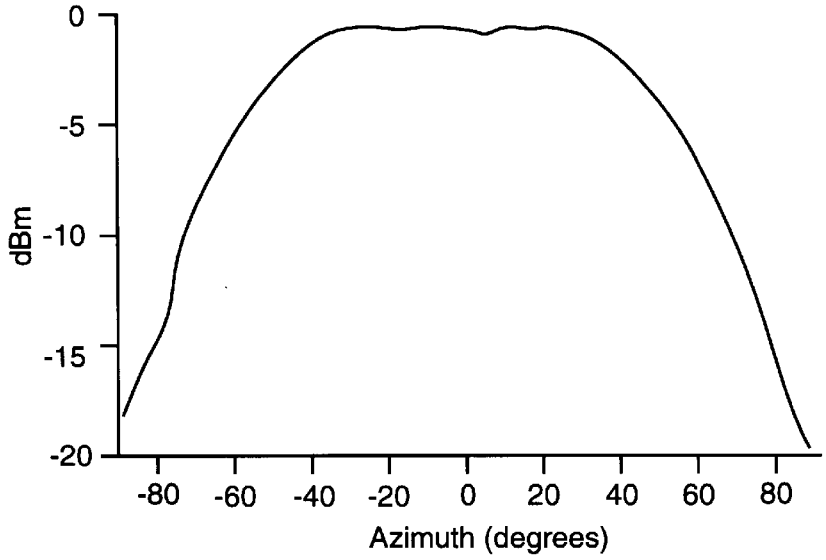
Fig. 8
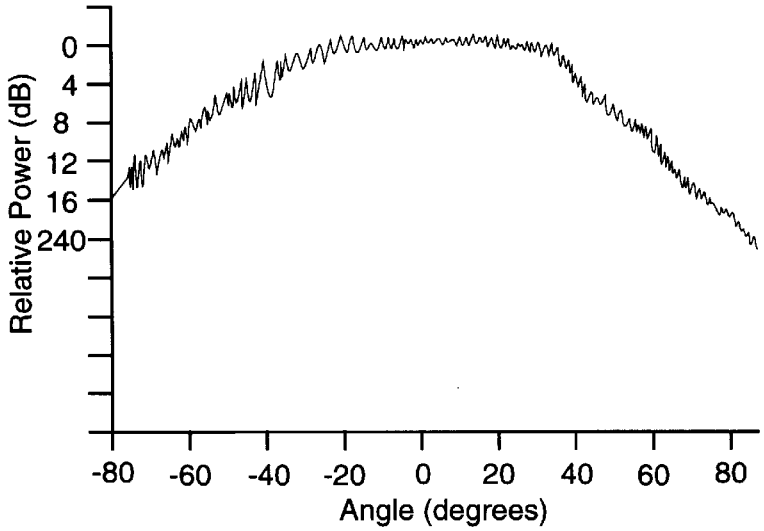
Fig. 9
Fig. 10
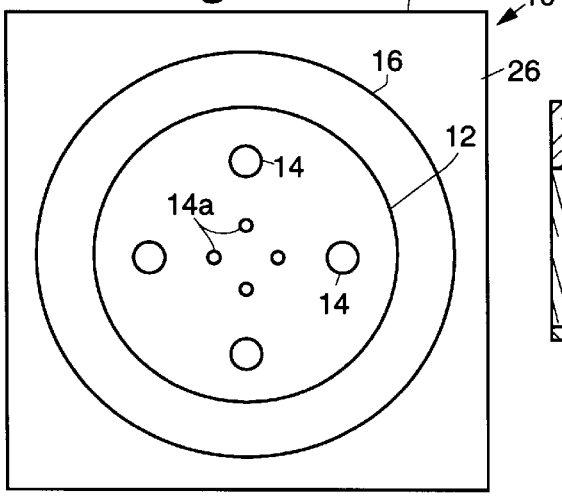
Fig. 11
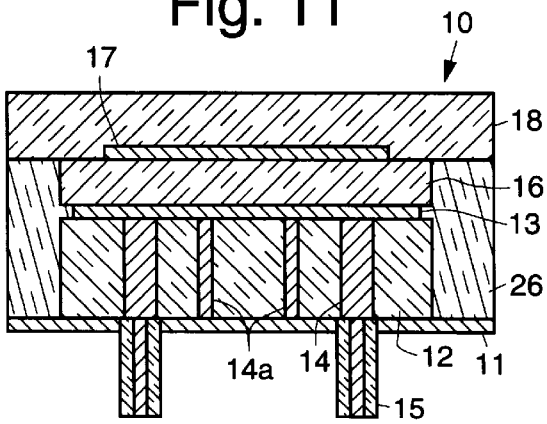

Fig. 12
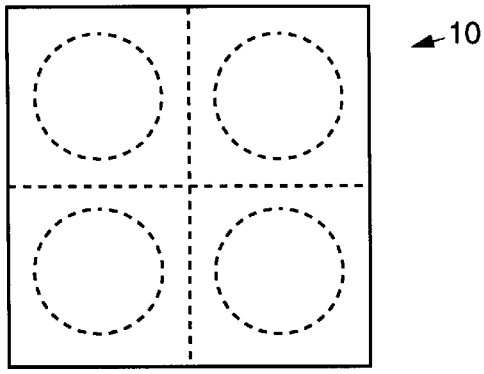
Fig. 13
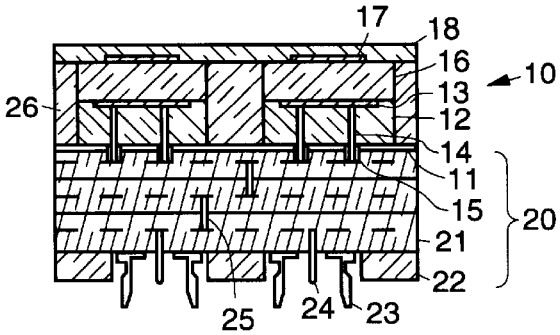
Fig. 14
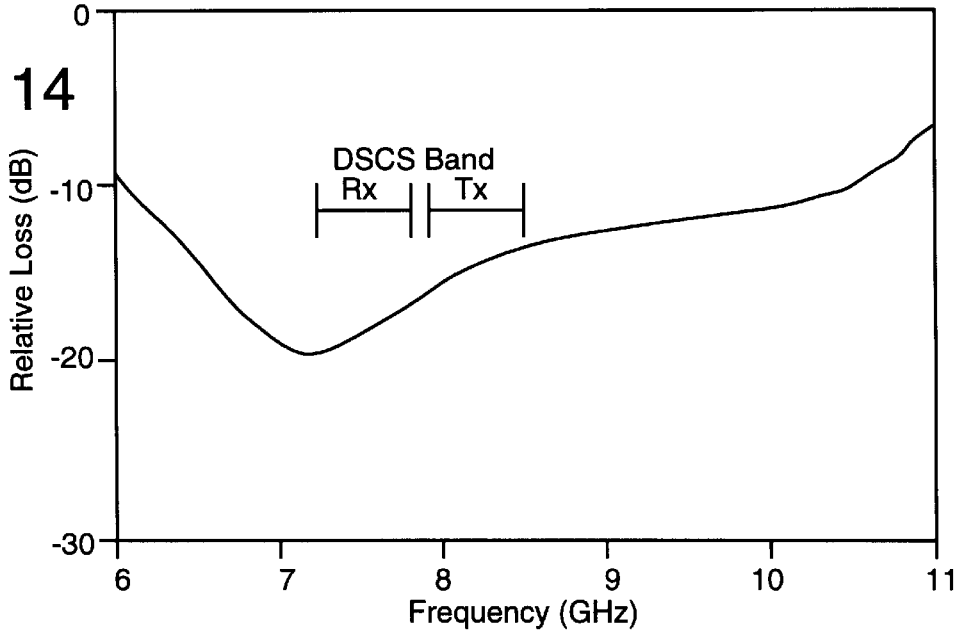
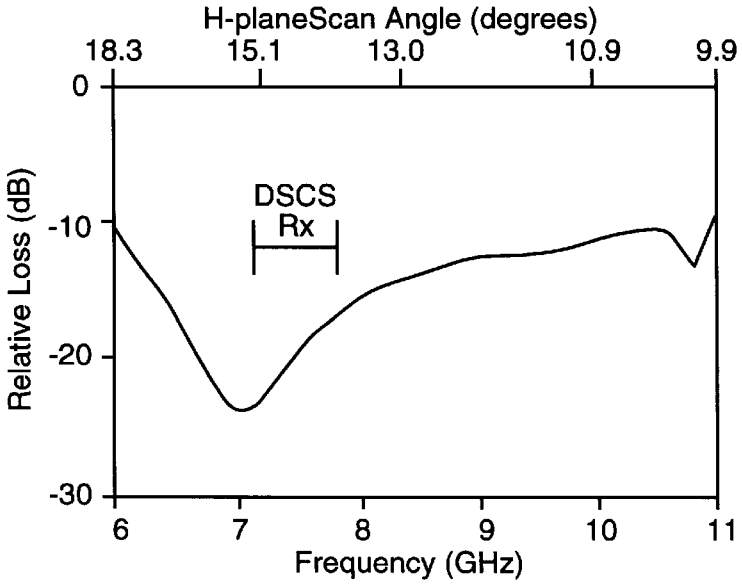
Fig. 15

PLANAR LOW PROFILE, WIDEBAND, WIDE-SCAN PHASED ARRAY ANTENNA USING A STACKED-DISC RADIATOR

BACKGROUND

The present invention relates generally to a phased array antennas, and more particularly, to planar, low profile phased array antennas employing stacked disc radiators.

In the past, the assignee of the present invention has developed a phased array antenna using a disc radiator disposed on a dielectric post. That design was limited to about 20% of the available bandwidth. Copending U.S. patent application Ser. No. 08/678,383, filed Jun. 28, 1996, entitled "Wide-Band/Dual-Band Stacked-Disc Radiators on Stacked-Dielectric Posts Phased Array Antenna," (PD-95223), where a phased array antenna using stacked-disc radiators on stacked-dielectric posts produced over an octave bandwidth. In the invention of Copending U.S. patent application Ser. No. 08/678,383, the discrete stacked-dielectric posts resulted in a non-planar design, and a radome was not used. In the open literature, there are several microstrip disc patch array antenna designs, but these designs have very limited capability in bandwidth and/or scan coverage performance.

Accordingly, it is an objective of the present invention to provide for planar, low profile phased array antennas employing stacked disc radiators.

SUMMARY OF THE INVENTION

To meet the above and other objectives, the present invention provides for a planar, low-profile, very wideband, wide-scan phased array antenna using stacked-disc radiators embedded in dielectric media. The phased array antenna has a rectangular arrangement of unit cells that each comprise a ground plane, and a lower dielectric puck comprising a high dielectric constant material disposed on the ground plane. An excitable disc is disposed within the perimeter of and on top of the lower dielectric puck. An upper dielectric puck comprising a low dielectric constant material that has a dielectric constant that is lower than that of the lower dielectric puck is disposed on the excitable disc. A parasitic disc is disposed within the perimeter of and on top of the upper dielectric puck. The unit cell surrounding the dielectric pucks comprises a dielectric material having a dielectric constant that is lower than that of the lower dielectric puck. A radome is disposed on top of the parasitic disc and the dielectric filler material. Two orthogonal pairs of excitation probes are coupled to the lower excitable disc.

The polarization of the phased array antenna may be single linear polarization, dual linear polarization, or circular polarization depending on whether a single pair or two pairs of excitation probes are excited. The phased array antenna may include a flush-mounted radome as part of its aperture. The phased array antenna has a low profile, is very compact, and can be made rigid. Its planar nature makes it well-suited for conformal applications and for tile array architectures, in general.

In the present invention, stacked-disc radiators are embedded inside dielectric media (with no air pockets), and the radome is an integral part of the antenna aperture. The entire antenna aperture of the phased array antenna is planar, has a low profile, and is well suited to be conformally mounted on the ground plane, all while maintaining its wideband, wide-scan performance.

In many of today's shipboard, submarine, or airborne satellite communication or radar operations, wide-band phased array antennas with dual linear or circular polarization are needed. The present invention provides for phased array antennas that meet the needs of these applications. The phased array antenna provides an octave-bandwidth performance with excellent scan and polarization behavior, the array is very compact, and has a low-profile, which are desirable characteristics of light-weight antennas. If necessary, the array can be made rigid wherein it is filled with noncompressible dielectric materials, as is required in applications that must withstand very high pressure or shock loads, such as in a submarine environment. For satellite communication, the present antenna can radiate with either dual-linear polarization, or both senses of circular polarization. The present phased array antenna is thus well-suited for use in submarine, satellite communication, airborne-related applications.

BRIEF DESCRIPTION OF THE DRAWINGS

The various features and advantages of the present invention may be more readily understood with reference to the following detailed description taken in conjunction with the accompanying drawings, wherein like reference numerals represent like structural elements, and in which

FIG. 5 shows the predicted return loss of the radiation impedance in a broadside case for the antenna of FIG. 3;

FIG. 6 shows a waveguide simulator measurement for the antenna of FIG. 3;

FIG. 7 shows a feeding scheme that produces both senses of circular polarization in the antenna of FIG. 3;

FIG. 8 shows a measured H-plane pattern at 9.0 GHz;

FIG. 9 shows the measured axial ratio of a circular polarized element pattern at 9.0 GHz;

FIGS. 10 and 11 show top and side views, respectively, of a second exemplary embodiment of the present antenna;

FIGS. 12 and 13 show top and side views, respectively, of a 2×2 subarray having a feed layer; and FIGS. 14 to 18 shows the predicted frequency performance for the 2×2 subarray shown in FIGS. 12 and 13.

DETAILED DESCRIPTION

Figure 1:
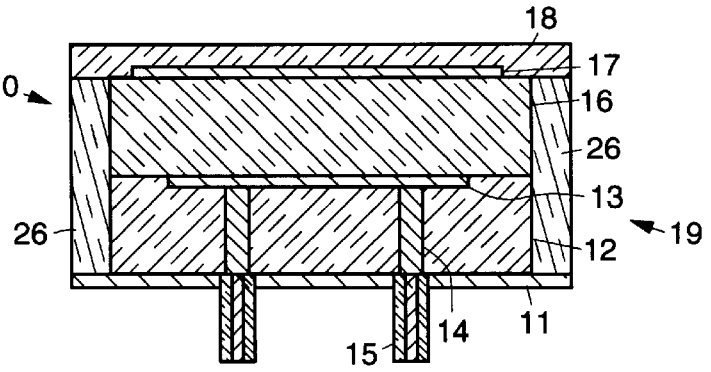
FIGS. 1 and 2 show partial side and top views, respectively, of a planar, low-profile, stacked-disc radiator phased array antenna in accordance with the principles of the present invention.
Figure 2:
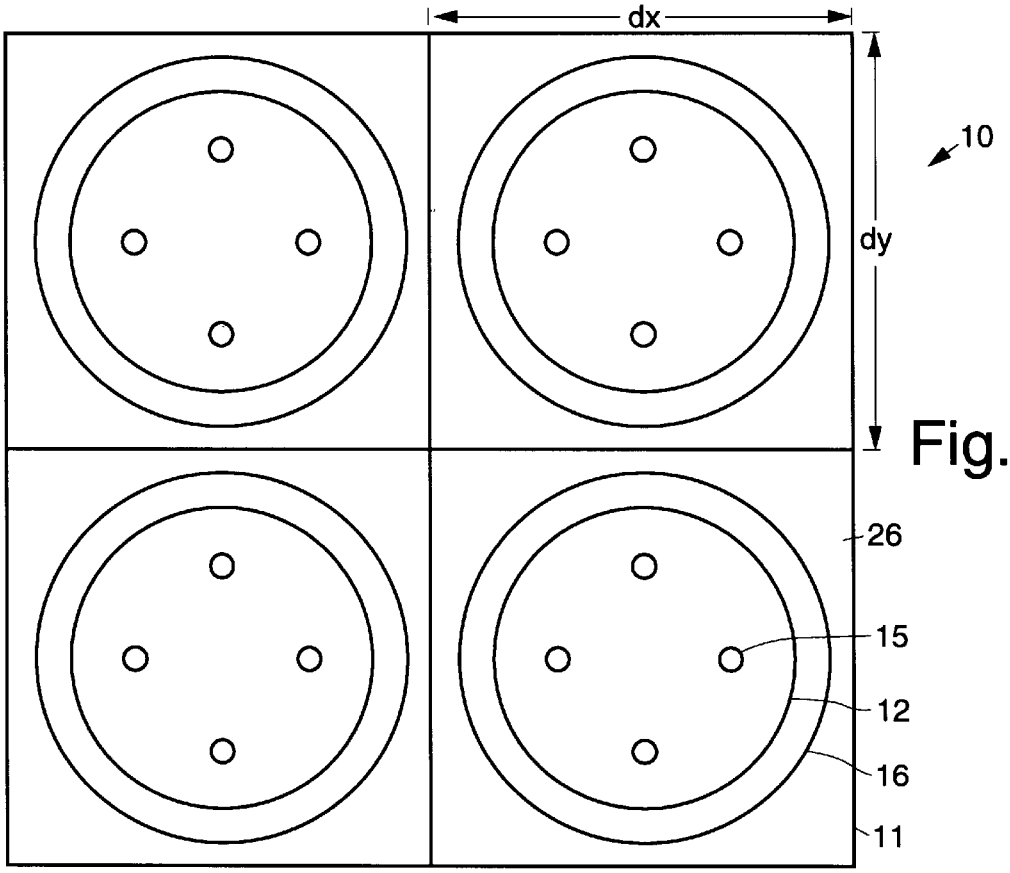

Referring to the drawing figures, FIGS. 1 and 2 show partial side and top views, respectively, of a planar, low-profile, stacked-disc radiator phased array antenna 10 in accordance with the principles of the present invention. Spacings (dx and dy) between elements 19 or unit cells 19 are the same and the unit cells 19 are disposed in a rectangular lattice arrangement. There are two (upper and lower) cylindrical dielectric pucks 16, 12 in each unit cell 19. The lower dielectric puck 12 is made of a high dielectric constant (high-K) material, and has a diameter $D_H$, dielectric constant $\epsilon_H$ and a thickness $t_1$. The lower dielectric puck 12 is disposed on a ground plane 11. An excitable disc 13 having diameter $D_1$ is printed on top of the high-K lower dielectric puck 12.

The upper puck 16 is a low-K dielectric puck 16 having a diameter $D_L$, dielectric constant $\epsilon_L$, and a thickness $t_2$. A parasitic disc 17 having diameter $D_2$ lies on top of the low-K dielectric puck 16. The low-K dielectric puck 16 is disposed on top of the high-K lower dielectric puck 12 and the excitable disc 13. Centers of the two dielectric pucks 16, 12 and the two discs 13, 17 are aligned.

The remainder of the unit cell 19 surrounding the two dielectric pucks 16, 12 comprises a low-K dielectric filler material 26 having a dielectric constant $\epsilon_s$. The dielectric filler material 26 may also be made the same material as the low-K dielectric puck 16, i.e., $\epsilon_s=\epsilon_L$. A radome 18 having a dielectric constant $\epsilon_r$ and thickness $t_r$ is disposed on top of the parasitic disc 17 and the dielectric filler material 26. The lower excitable disc 13 is excited by two pairs of excitation probes 14, arranged in orthogonal locations. The probe separation is S for each pair of excitation probes 14. Each pair of excitation probes 14 is fed by coaxial cables 15, with 180° phase reversal.

The upper parasitic disc 17 is parasitically excited, and is not directly fed by the probes 14. In the presence of mutual coupling, the lower excitable disc 13 is tuned to operate at a lower frequency band, while the parasitic disc 17 is tuned to higher frequencies. Consequently, the operational bandwidth of the antenna 10 is extended to encompass the lower and higher frequency bands. The two pairs of excitation probes 14 provide dual-linear polarization and circular polarization capability. More particularly, the polarization of the phased array antenna 10 may be single linear polarization, dual linear polarization, or circular polarization depending on whether a single pair or two pairs of excitation probes 14 are excited.

Figure 3:
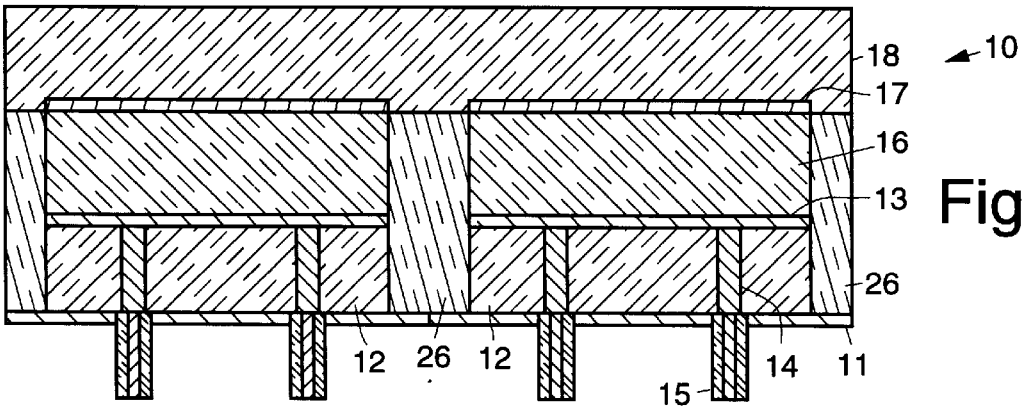
FIG. 3 shows a first exemplary embodiment of the present antenna.

FIG. 3 shows a first exemplary embodiment of the present antenna 10 that operates over an octave band from 7 GHz to 14 GHz. In this embodiment, the dielectric constant of the surrounding low-K filler material 26 is chosen to be the same as the dielectric constant of the low-K dielectric puck 16. This results in a simple planar geometry for the antenna 10. Exemplary parameters for the embodiment of the antenna 10 shown in FIG. 3 are as follows: element spacings dx=dy=0.410" in a rectangular lattice; high-K puck $\epsilon_H$=6.0, diameter=0.346", and thickness=0.075"; low-K puck $\epsilon_L$=1.70, diameter=0.346", and thickness=0.0485"; the surrounding low-K substance $\epsilon_S$=1.70; the lower disc diameter=0.340"; the upper disc diameter=0.260"; the radome has a dielectric constant $\epsilon_r$=3.40, and a thickness=0.030"; and the separation between each pair of probes=0.226".

Figure 4:
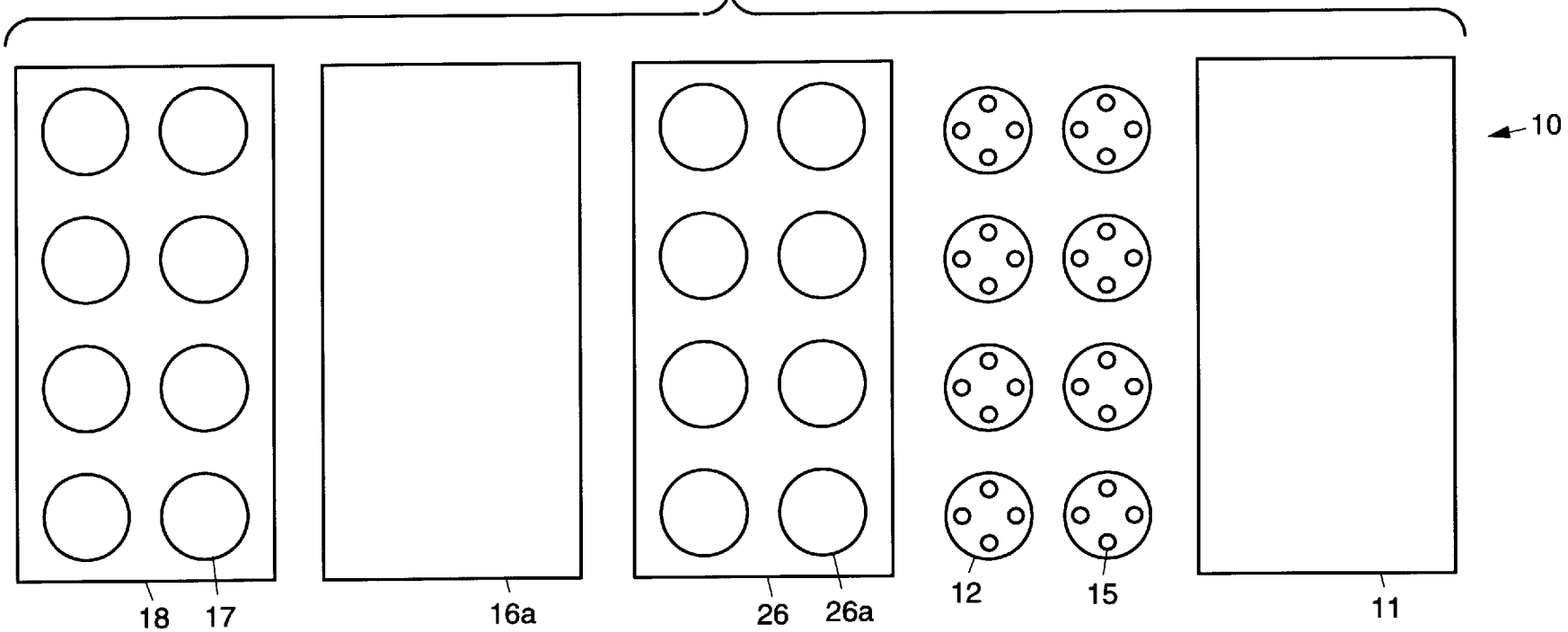
FIG. 4 shows different parts of the radiator design in a 2×4 subarray.
Figure 16:
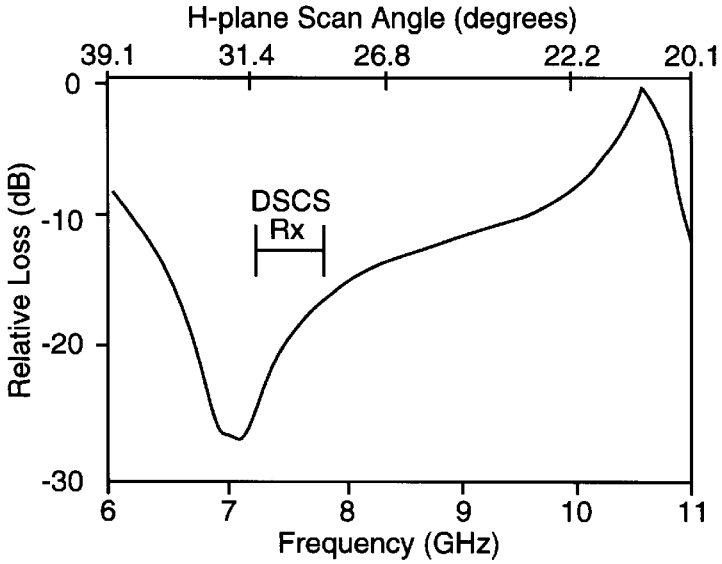
Figure 17:
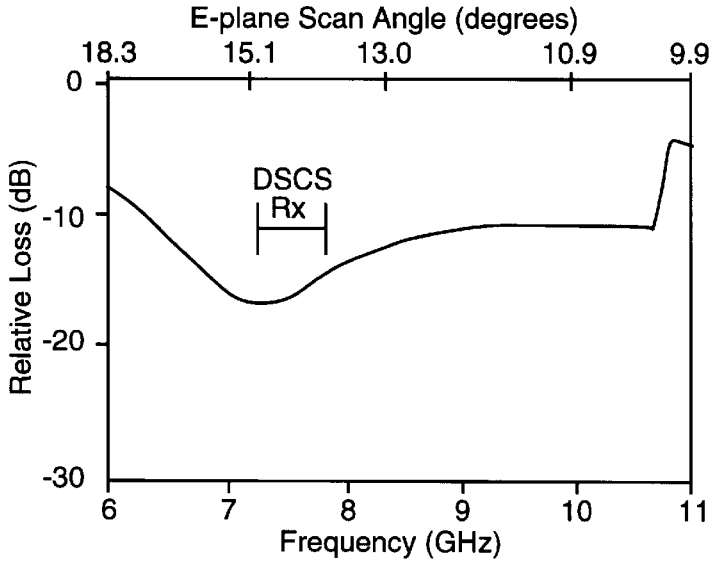
Figure 18:
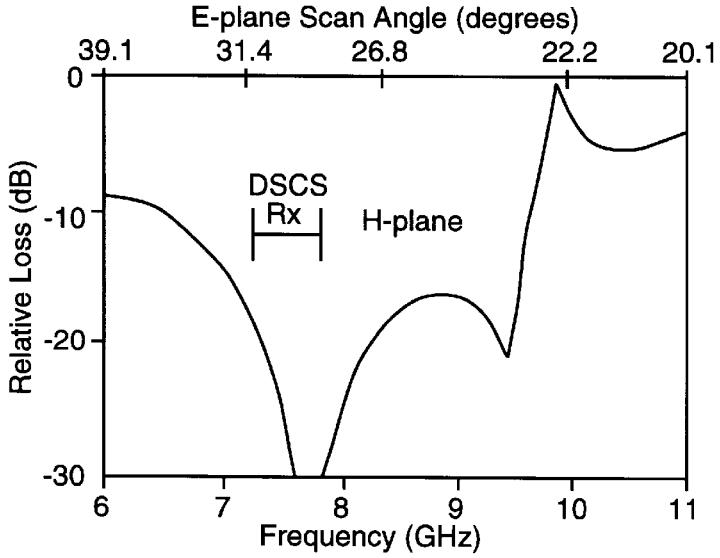

FIG. 4 shows the different components used to construct an embodiment of the present antenna 10 fabricated as a 2×4 subarray. FIG. 4 shows the ground plane 11 at the right side of the figure. To the left of the ground plane 11 is shown a set of high-K lower dielectric pucks 12 looking through the ground plane 11 which shows the coaxial cables 15 which would protrude through the ground plane 11. The excitable discs 13 are not shown, but are disposed below the lower dielectric pucks 12 shown in FIG. 4. A layer of filler material 26 having openings 26*a* therein that surround the high-K lower dielectric pucks 12 is depicted to the left of the set of high-K lower dielectric pucks 12. In the embodiment of the antenna 10 shown in FIG. 4, the low-K dielectric pucks 16 shown in FIGS. 1 and 3, for example, have been replaced by a single low-K dielectric layer 16*a*, which is depicted to the left of the layer of filler material 26. The radome 18 is depicted to the left of the low-K dielectric layer 16*a*, and has the parasitic discs 17 printed on its bottom surface which faces the upper surface of the low-K dielectric layer 16*a*.

The predicted return loss of the radiation impedance in a broadside case for the embodiment of the antenna 10 FIG. 3 is shown in FIG. 5. From 7 GHz to 14 GHz, the return loss is below -10 dB. The mismatch is better then 3:1 VSWR within 45° scan coverage over a 7 to 14 GHz. A waveguide simulator was built to validate the predicted data. The validation data derived for the antenna 10 of FIG. 3 using the waveguide simulator is shown in FIG. 6.

A feeding arrangement for the antenna 10 of FIG. 3 that produces both senses of circular polarization is shown in FIG. 7. The four probes 14 of each disc antenna 10 are excited in phase sequence in the manner shown in FIG. 7. This may be achieved by feeding two orthogonal pairs of probes 14 using two 180° hybrids 32, 33 and combining the outputs with a 90° hybrid 31.

More specifically, the 90° hybrid 31 receives left hand circularly polarized (LHCP) and right hand circularly polarized (RHCP) excitation signals. 0° and 90° outputs of the 90° hybrid 31 are coupled to first and second 180° hybrids 32, 33, respectively. The 0° output of the 90° hybrid 31 feeds the first 180° hybrid 32, while the 90° output of the 90° hybrid 31 feeds the second 180° hybrid 33. 0° and 180° outputs of the first 180° hybrid 32 are coupled to probes 14 located at 0° and 180°, respectively. 0° and 180° outputs of the second 180° hybrid 33 are coupled to probes 14 located at 90° and 270°, respectively.

A 5×5 test array antenna 10 was built to measure the element patterns. FIG. 8 shows a measured H-plane pattern at 9.0 GHz and FIG. 9 shows a measured axial ratio of a circular polarized element pattern at 9.0 GHz for the 5×5 test array antenna 10. These patterns indicate that the present phased array antenna 10 has very good scan and axial ratio performance.

FIGS. 10 and 11 show top and side views, respectively, of a second exemplary embodiment of the present antenna 10. The parameters of this antenna 10 are as follows: element spacings dx=dy=0.780" in a rectangular lattice; high-K puck $\epsilon_H$=3.27, diameter=0.535", and thickness=0.120"; low-K puck $\epsilon_L$=1.70, diameter=0.535", and thickness=0.061"; the surrounding low-K substance $\epsilon_S$=1.70; the lower disc diameter=0.520"; the upper disc diameter=0.320"; the radome has a dielectric constant $\epsilon_r$=2.50, and thickness=0.074"; and the separation between each pair of probes S=0.330". There are four tuning or shorting pins 14*a* symmetrically disposed around the center of the lower dielectric puck 12 to connect to the ground plane 11. These shorting pins 14*a* increase E-plane scan coverage in the high end of the frequency band.

FIGS. 12 and 13 show top and side views, respectively, of a 2×2 subarray antenna 10 having a feed layer 20. The feed layer packaging 20 comprises multilayer stripline feed printed wiring board 21 having a plurality of stripline vias 25 that cooperatively extend therethrough. A plurality of connectors 23 have housings that are coupled to the ground plane 11, and have center pins 24 that are coupled to a lower layer of the multilayer stripline feed printed wiring board 21. Selected ones of the plurality of stripline vias 25 are coupled between the center pins 24 and the probes 14 of the antenna 10. The plurality of stripline vias 25 are used to transfer input signals from the center pins 24 to the respective probes 14 and lower excitable discs 13 of the antenna 10.

FIGS. 14 to 18 shows the predicted frequency performance for a large array antenna 10 using a plurality of the 2×2 subarrays shown in FIGS. 12 and 13. FIG. 14 shows the return loss of the radiation impedance of the antenna 10 at broadside. FIGS. 15–18 depict the return loss of the radiation impedance at H- and E-plane scan cases, respectively, of the antenna 10. Over the frequency band from 6.0 to 9.5

GHz range, this phased array antenna 10 has excellent aperture impedance match.

In addition to the two above-described embodiments, planar antennas 10 have also been developed for 0.55" and 0.67" square lattices, as well as for several triangular lattice arrangements. All designs have the universal wideband, wide-scan properties of the planar stacked disc radiator antenna 10 of the present invention.

Thus, planar, low profile phased array antennas employing a stacked disc radiator have been disclosed. It is to be understood that the described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A planar, low profile phased array antenna comprising:

a rectangular arrangement of unit cells that each comprise:

a ground plane;

a lower dielectric puck comprising a high dielectric constant material disposed on the ground plane;

an excitable disc disposed within the perimeter of and on top of the lower dielectric puck;

an upper dielectric puck comprising a low dielectric constant material that has a dielectric constant that is lower than that of the lower dielectric puck disposed on the excitable disc;

a parasitic disc disposed within the perimeter of and on top of the upper dielectric puck;

and wherein the unit cell surrounding the dielectric pucks comprises a dielectric filler material having a dielectric constant that is lower than that of the lower dielectric puck;

a radome disposed on top of the parasitic disc and the dielectric filler material; and two orthogonal pairs of excitation probes coupled to the lower excitable disc.

2. The antenna of claim 1 wherein centers of the upper and lower dielectric pucks and the excitable and parasitic discs are aligned.

3. The antenna of claim 1 wherein the unit cell surrounding the dielectric pucks comprises a dielectric filler material having a dielectric constant that is equal to that of the upper dielectric puck.

4. The antenna of claim 1 wherein the upper and lower dielectric pucks and the excitable and parasitic discs are cylindrical.

5. The antenna of claim 1 wherein each pair of excitation probes is fed by a separate coaxial cable, with 180° phase reversal.

6. The antenna of claim 1 further comprising a feed layer that comprises:

a multilayer stripline feed printed wiring board having a plurality of stripline vias that extend therethrough, and a plurality of connectors having center pins coupled to stripline vias of the multilayer stripline feed printed wiring board that couple to respective the pairs of excitation probes.

7. The antenna of claim 1 further comprising:

a feeding arrangement that produces both senses of circular polarization that comprises a 90° hybrid having outputs that feed two 180° hybrids whose outputs are coupled to the respective probes of the orthogonal pairs of probes.

8. The antenna of claim 7 wherein the 90° hybrid receives left hand circularly polarized and right hand circularly polarized excitation signals, and 0° and 90° outputs of the 90° hybrid are coupled to first and second 180° hybrids, respectively, the 0° output of the 90° hybrid feeds the first 180° hybrid, while the 90° output of the 90° hybrid feeds the second 180° hybrid, 0° and 180° outputs of the first 180° hybrid are coupled to the first pair of probes, and 0° and 180° outputs of the second 180° hybrid are coupled to the second pair of probes.

* * * * *